US007848681B2

(12) United States Patent
Ogiwara

(10) Patent No.: US 7,848,681 B2
(45) Date of Patent: Dec. 7, 2010

(54) METHOD OF ROTATING REVOLVER UNIT USING A PLURALITY OF MOTORS

(75) Inventor: Takashi Ogiwara, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 539 days.

(21) Appl. No.: 11/955,038

(22) Filed: Dec. 12, 2007

(65) Prior Publication Data

US 2008/0226318 A1 Sep. 18, 2008

Related U.S. Application Data

(60) Provisional application No. 60/895,366, filed on Mar. 16, 2007.

(51) Int. Cl.
*G03G 15/01* (2006.01)

(52) U.S. Cl. ..... 399/227; 399/167

(58) Field of Classification Search ..... 399/227
See application file for complete search history.

(56) References Cited

U.S. PATENT DOCUMENTS 5,325,151 A * 6/1994 Kimura et al. ..... 399/227
2007/0184837 A1* 8/2007 Hohl et al. ..... 455/435.1

FOREIGN PATENT DOCUMENTS

JP 11-316479 11/1999
JP 2006243481 A * 9/2006

* cited by examiner

*Primary Examiner*—David M Gray
*Assistant Examiner*—Roy Yi
(74) *Attorney, Agent, or Firm*—Turocy & Watson, LLP

(57) ABSTRACT

According to an embodiment of the invention, a revolver unit is rotationally driven by using three stepping motors. The weight of developing cartridges loaded on the revolver unit is identified on the basis of the quantity of remaining toner in toner cartridges. At the time of rotationally driving the revolver unit, output timing of the stepping motor closer to the developing cartridge which has a large quantity of remaining toner and has a heavy weight is made earlier, and output timing of the stepping motor far from this developing cartridge is delayed.

22 Claims, 8 Drawing Sheets

METHOD OF ROTATING REVOLVER UNIT USING A PLURALITY OF MOTORS

CROSS REFERENCE TO RELATED APPLICATION

This invention is based upon and claims the benefit of priority from prior U.S. patent application Ser. No. 60/895,366 filed on Mar. 16, 2007, the entire contents of which are incorporated herein by reference.

BACKGROUND OF THE INVENTION

1. Field of the Invention

The present invention relates to an image forming apparatus such as an electrophotographic apparatus, a printer or the like and to an image forming apparatus having a developing unit which is equipped with developers for plurality of colors and provided rotatably.

2. Description of the Related Art

As an image forming apparatus such as a color copy machine, a color printer or the like which provides color images by an electrophotographic system, there is an apparatus having a revolver-type developing device in which a developing unit having an integrated developing device and toner cartridge and equipped with a plurality of developers is rotated to move a developer of a desired color to a developing position and develop an electrostatic latent image. In conventional such a revolver-type developing unit is driven by one motor in most cases. In such an image forming apparatus, since a desired developer of the heavy-weight developing unit is stopped accurately at a developing position, a motor of high performance is required for driving the developing unit. However, when such a heavy developing unit is to be driven by one motor, a large load torque is generated at a part where the developing unit engages with the motor. This makes the rotational driving of the developing unit unstable, and causes the developing unit to vibrate and deviate from the stopping position. Moreover, there is a risk of step-out of the motor.

Thus, conventional, JP-A-11-316479 discloses an image forming apparatus in which the rotation speed of the revolver unit is adjusted in accordance with periodic change of torque generated between the revolver unit and the motor, thus restraining increase in load torque and preventing the motor from stepping out. However, in this conventional image forming apparatus, though increase in load torque due to the torque change can be restrained, the original load torque itself generated in the gear of the heavy revolver unit is not reduced.

Therefore, the load torque generated in the gear of the revolver unit is still large and it makes rotational driving of the revolver unit unstable. There still is a risk of vibration of the revolver unit and occurrence of step-out of the motor. Particularly, when the acceleration of the motor changes, such as when the rotation of the revolver unit starts or stops, the momentary load torque generated in the gear of the revolver unit increases further. Also, because of the high-speed rotation of the revolver unit due to the higher speed of the recent color apparatus, the load torque generated in the gear of the revolver unit increase further and it may affect vibration of the revolver unit or step-out of the motor.

Thus, it is desired that a highly reliable image forming apparatus should be provided which provides a color developed image by using the revolver-type developing unit, the load torque itself generated in the gear when rotationally driving the developing unit is reduced to prevent vibration of the developing unit or its deviation from the stopping position and to prevent occurrence of step-out of the motor.

SUMMARY OF THE INVENTION

According to an aspect of the invention, the load torque generate in the gear when rotationally driving the developing unit is reduced. As a result, irrespective of change in acceleration of the motor or high-speed rotation of the developing unit, vibration of the developing unit or step-out of the motor is prevented and the developing unit is rotationally driven stably.

According to an embodiment of the invention, an image forming apparatus includes: a developing unit which has a plurality of developers to move to a developing position and develop an electrostatic latent image and which is rotatably supported in an image forming apparatus body; and a plurality of driving members which rotationally drive the developing unit and move a desired one of the developers to the developing position.

DETAILED DESCRIPTION OF THE PREFERRED EMBODIMENTS

Figure 1:
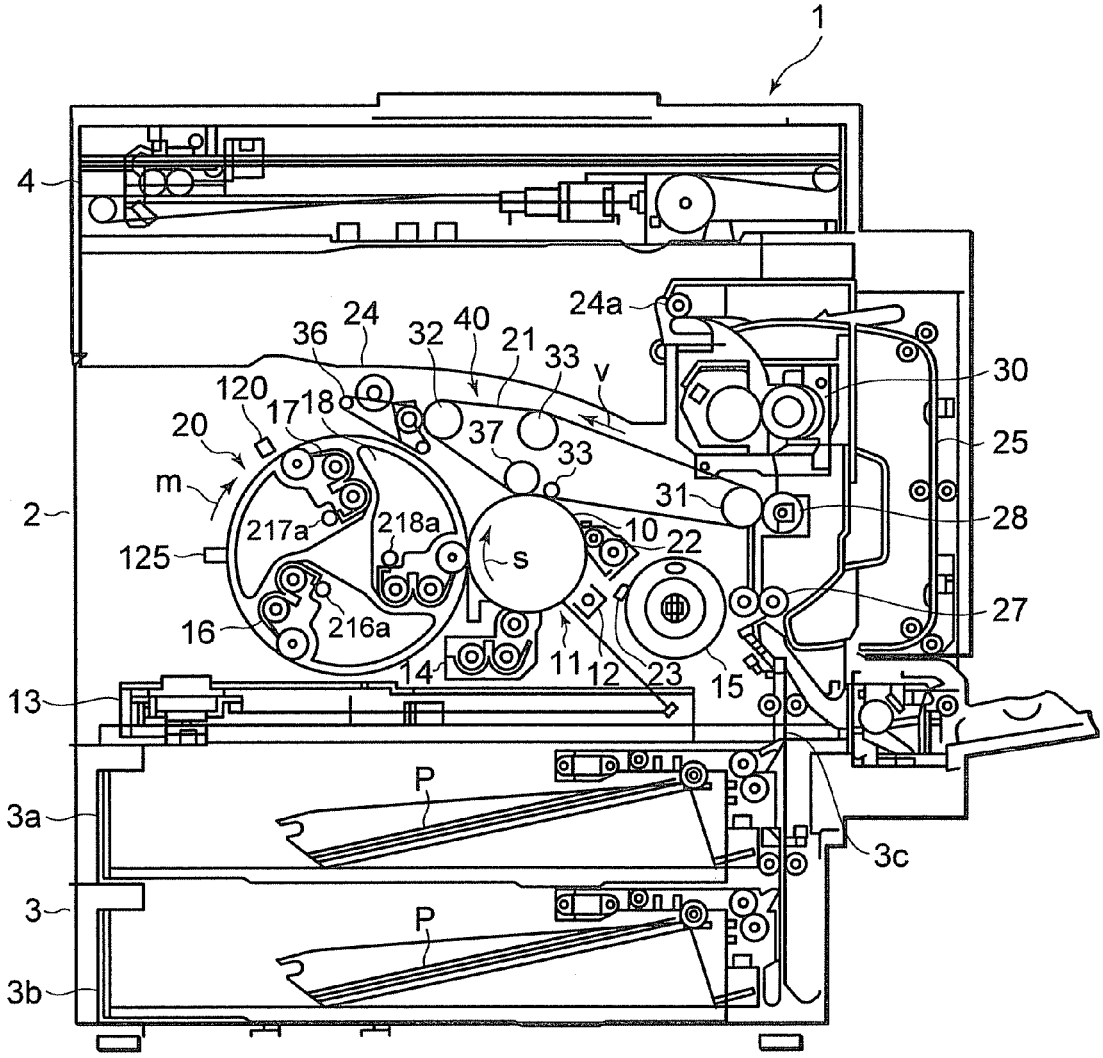
FIG. 1 is a configuration view schematically showing a color printer according to a first embodiment of the invention.

Hereinafter, an embodiment of the invention will be described in detail with reference to the accompanying drawings. FIG. 1 is a schematic configuration view showing a color printer 1, which is an image forming apparatus according to a first embodiment of the invention. The color printer 1 has a printer unit 2, a paper feed unit 3 which supplies a sheet paper P to the printer unit 2, and a scanner unit 4 which reads an original image.

A toner image forming unit 11, which is an image forming member to form toner images of a plurality of colors on the photoconductive drum 10, is provided around a photoconductive drum 10 of the printer unit 2. The toner image forming unit 11 has a charger device 12 which uniformly charges the photoconductive drum 10, a laser exposure device 13 which forms an electrostatic latent image on the charged photoconductive drum 10 on the basis of image data from the scanner unit 4, and a black developing device 14 which is supplied with toner from a black toner cartridge 15, sequentially in accordance with the rotation of the photoconductive drum 10 in the direction of an arrow s. Moreover, a revolver unit 20 which supports a yellow (Y) developing cartridge 16, a magenta (M) developing cartridge 17 and a cyan (C) developing cartridge 18 in a replaceable manner is provided downstream of the black developing device 14.

Moreover, a transfer belt device 40 is arranged facing a transfer position around the photoconductive drum 10. The transfer belt device 40 has a transfer belt 21. The transfer belt 21 is tensioned by a plurality of tension rollers 33 and is turned in the direction of an arrow v by a belt driving roller 32. At the position where the transfer belt 21 contacts the photoconductive drum 10, a primary transfer roller 37 is provided which applies a primary transfer bias between the transfer belt and the photoconductive drum 10. Also, the transfer belt 21 is supported by a secondary transfer counter-roller 31 at a secondary transfer position. At the secondary transfer position of the transfer belt 21, a secondary transfer roller 28 is provided which applies a secondary transfer bias between the transfer belt and the sheet paper P. A belt cleaner 36 is provided around the transfer belt 21 after passing the secondary transfer position. A drum cleaner 22 and an electricity removing LED 23 are arranged at parts which are around the photoconductive drum 10 and downstream of the position where it contacts the transfer belt 21.

The paper feed unit 3 having paper feed cassettes 3*a* and 3*b* to supply the sheet paper P in the direction of the secondary transfer roller 28 of the printer unit 2 is provide below the printer unit 2. The paper feed unit 3 takes out the sheet paper P from the paper feed cassettes 3*a* and 3*b* and supplies the sheet paper P along a carrying path 3*c* and in the direction of resist rollers 27.

In the carrying path 3*c* for the sheet paper P downstream from the secondary transfer roller 28, a fixing device 30 which fixes the toner images on the sheet paper P and a paper discharge roller 24*a* which discharges the sheet paper P after fixation to a paper discharge unit 24, are provided. Moreover, the printer unit 2 has a reverse carrying path 25 which reverses the sheet paper P at the time of double-side image formation.

Figure 2:
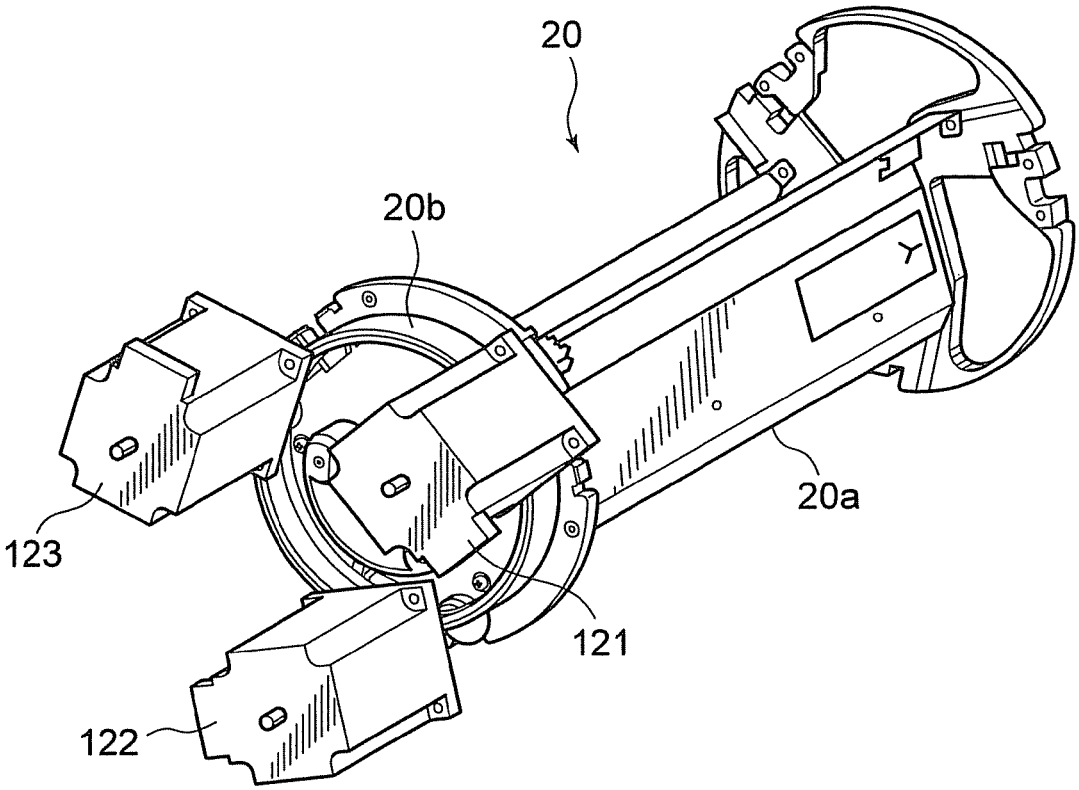
FIG. 2 is a schematic perspective view showing a holding member of a revolver unit and a stepping motor according to the first embodiment of the invention.
Figure 3:
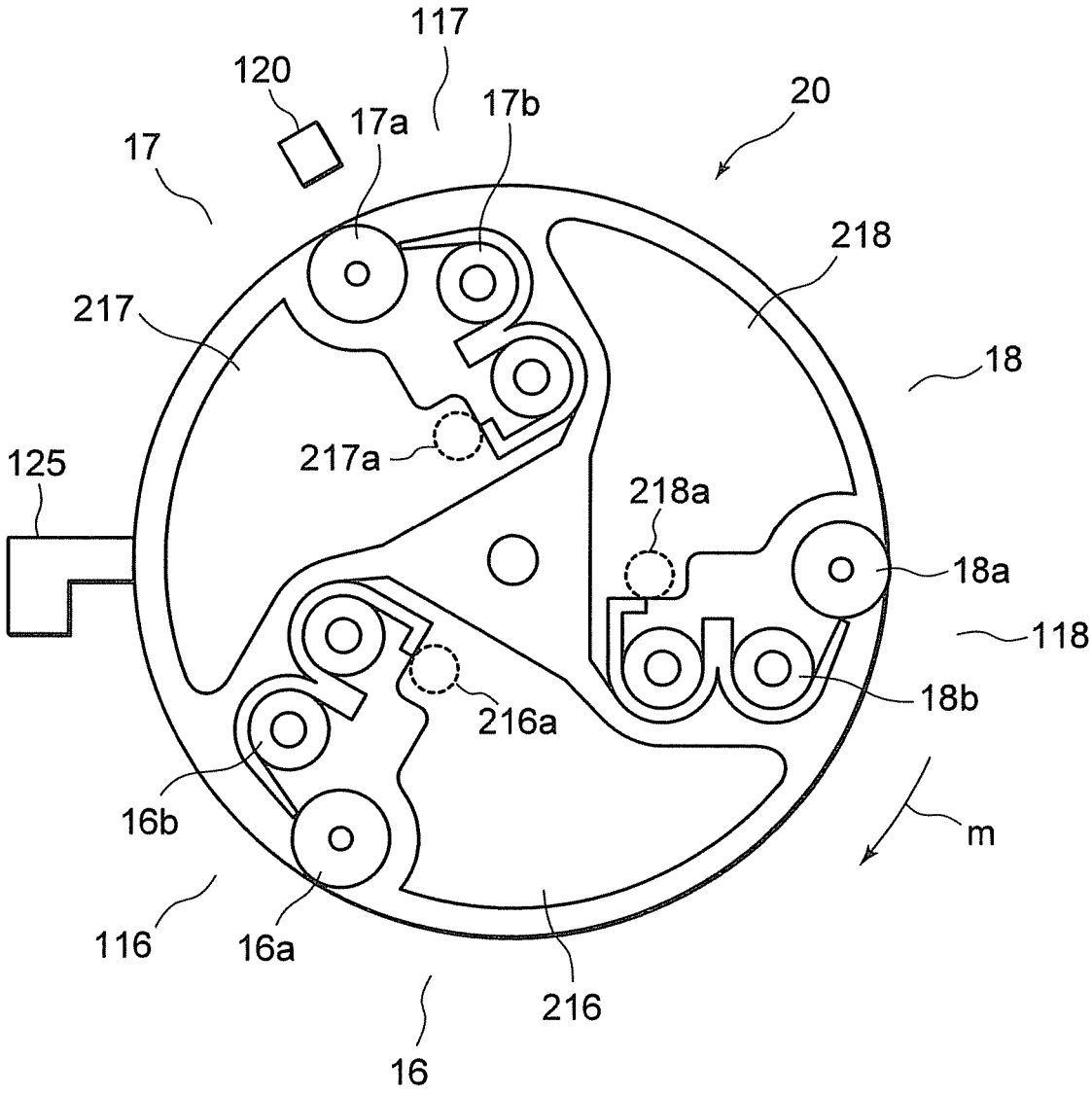
FIG. 3 is a schematic configuration view showing the revolver unit according to the first embodiment of the invention.

Next, the revolver unit 20 will be described in detail. As shown in FIG. 2 and FIG. 3, the revolver unit 20 supports the yellow (Y), magenta (M) and cyan (C) developing cartridges 16, 17 and 18 by a holding member 20*a*. The yellow (Y), magenta (M) and cyan (C) developing cartridges 16, 17 and 18 include, respectively, developing device units 116, 117, 118 having developing rollers 16*a*, 17*a*, 18*a*, and toner cartridges 216, 217, 218 which supply toner to the yellow (Y), magenta (M) and cyan (C) developing device units 116, 117, 118. The developing device units 116, 117 and 118 have developer carrier units 16*b*, 17*b*, 18*b* which supply a developer to the developing rollers 16*a*, 17*a*, 18*a*, and the developing rollers 16*a*, 17*a*, 18*a*.

The developing device units 116, 117 and 118 do not have their own driving mechanisms. Only when each of the developing device units is at the developing position facing the photoconductive drum 10, the driving of a developer motor 167, which will be described later, is transmitted to them. The developer motor 167 also drives the black developing device 14. When the revolver unit 20 is rotationally driven, a developer driving clutch 168 is turned off and the driving of the developer motor 167 is not transmitted to the developing device units 116, 117 and 118.

At a position 120° away from the developing position around the revolver unit 20 in the rotating direction of the revolver unit 20, a toner density sensor 120 is provided which detects toner density near the developing rollers 16*a*, 17*a* and 18*a*. Also, at a position 180° away from the developing position in the rotating direction of the revolver unit 20, a home position sensor 125 is provided which detects a home position of the revolver unit 20.

The toner density sensor 120 detects, for example, toner density near the magenta (M) developing roller 17*a* when the cyan (C) developing cartridge 18 is carrying out developing operation. Next, the toner density sensor 120 detects toner density near the yellow (Y) developing roller 16*a* when the magenta (M) developing cartridge 17 is carrying out developing operation. Next, the toner density sensor 120 detects toner density near the cyan (C) developing roller 18*a* when the yellow (Y) developing cartridge 16 is carrying out developing operation.

In accordance with the results of toner density detection by the toner density sensor 120, the yellow (Y) magenta (M) and cyan (C) developing device units 116, 117 and 118 are respectively supplied with toner from the toner cartridges 216, 217 and 218, when necessary. The supply of toner to the developing device units 116, 117 and 118 is carried out as the developer motor 167 is rotationally driven at the developing position.

For example, in the case where the toner density sensor 120 has detected that the cyan (C) developing device unit 118 has not reached prescribed toner density, first, the cyan (C) developing cartridge 18 is moved to the developing position. The developer motor 167 is driven to rotate a cyan (C) toner supply auger 218*a* located at the developing position for a prescribed time, thus supplying toner. Toner supply to the yellow (Y) and magenta (M) developing device units 116 and 117 is similarly carried out. Depending on how many times the toner supply of a prescribed time is carried out with each of the toner supply augers 216*a*, 217*a* and 218*a*, the quantity of supplied toner (that is, the quantity of remaining toner in the toner cartridges 216, 217 and 218) can be recognized.

After the supply of toner, toner density is measured again by the toner density sensor 120. In the case where toner density after the supply of toner has not reached the prescribed value, the above toner supply operation is repeated until toner density near the developing rollers 16*a*, 17*a* and 18*a* reaches the prescribed value.

Figure 4:
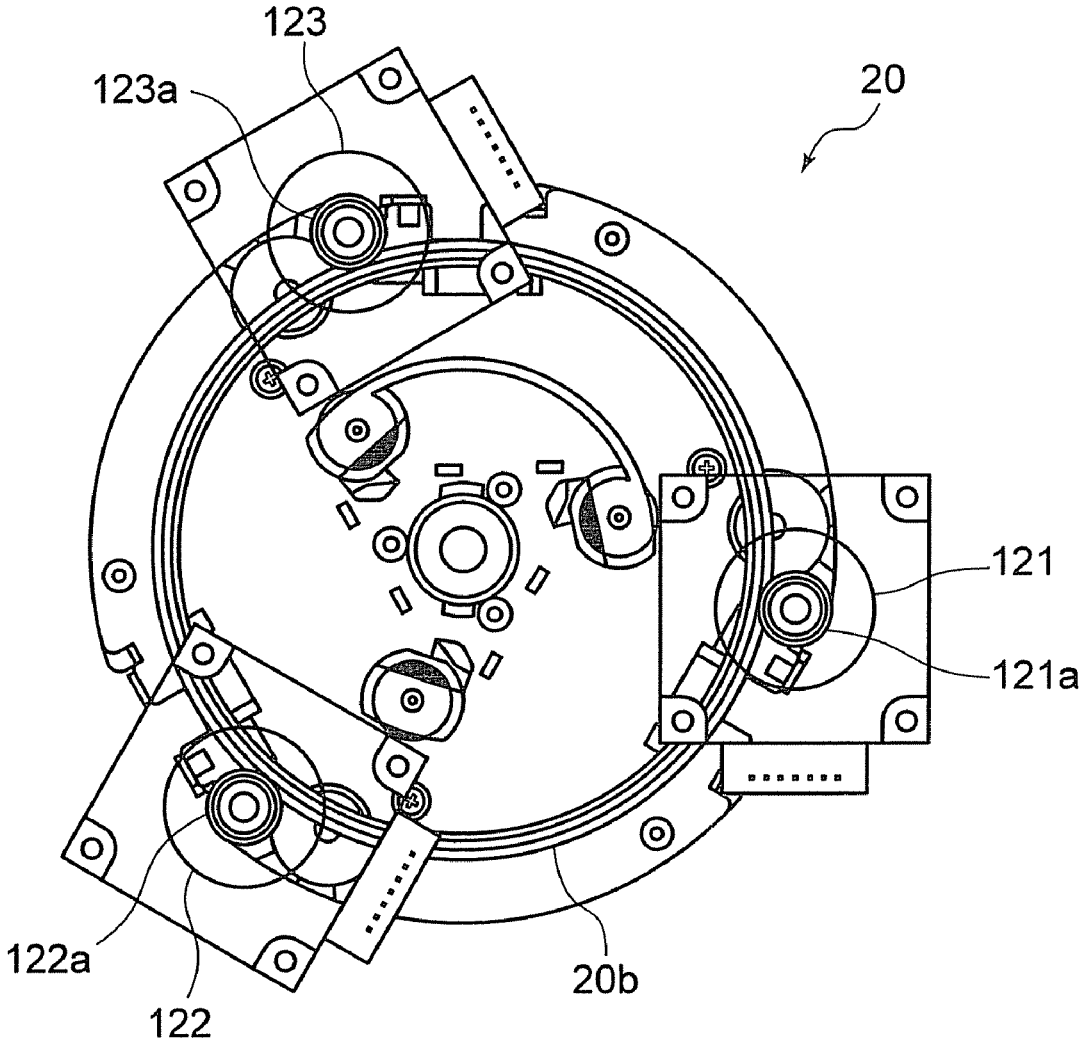
FIG. 4 is a schematic explanatory view showing a follower gear of the holding member and the stepping motor according to the first embodiment of the invention.

Meanwhile, as shown FIG. 4 in the rear side of the color printer 1, first to third stepping motors 121 to 123 are provided, which are driving members to rotationally drive the revolver unit 20. Driving shafts 121*a*, 122*a* and 123*a* of the first to third stepping motors 121 to 123 engage with a follower gear 20*b* on the rear side of the holding member 20*a*. The holding member 20*a* is rotationally driven in the direction of an arrow m by the driving of the first to third stepping motors 121 to 123.

Since the revolver unit 20 is rotationally driven by the first to third stepping motors 121 to 123, the home position of the revolver unit 20 is detected by the home position sensor 125 at the time of turning on the power of the color printer 1 or at the time of warm-up after opening and closing the front cover.

Figure 5:
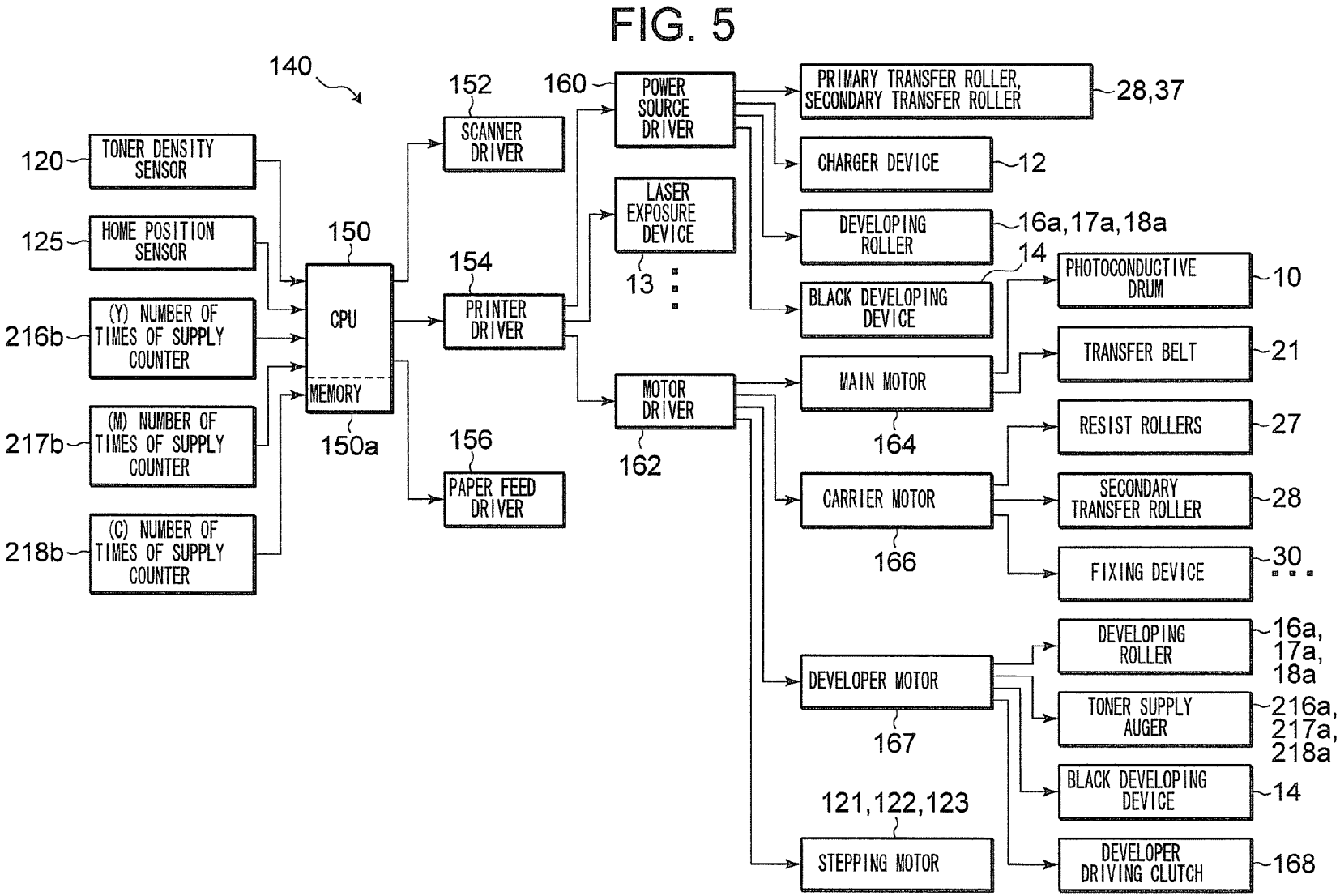
FIG. 5 is a block diagram showing a part of a control system of the color printer according to the first embodiment of the invention.

Driving control of the first to third stepping motors 121 to 123 is carried out by a control system 140 shown in the block diagram of FIG. 5. The toner density sensor 120, the home position sensor 125, number of times of supply counters 216*b*, 217*b* and 218*b* of the yellow (Y), magenta (M) and cyan (C) toner supply augers 216*a*, 217*a* and 218*a*, and so on are connected to the input side of a CPU 150 which controls the entire color printer 1. A scanner driver 152, a printer driver 154, a paper feed driver 156 and so on are connected to the output side of the CPU 150. The printer driver 154 is connected with a power source driver 160 which performs voltage control or the like of the charger device 12, the primary transfer roller 37, the secondary transfer roller 28, the developing rollers 16*a*, 17*a*, 18*a*, and the black developing device 14, and also to the laser exposure device 13 and so on.

Moreover, a motor driver 162 is connected to the output side of the CPU 150. The motor driver 162 controls a main motor 164 which rotationally drives the photoconductive drum 10 and the transfer belt 21, a carrier motor 166 which rotationally drives the carrier system including the fixing device 30, the secondary transfer roller 28, the resist rollers 27 and the like, the developer motor 167 which rotationally drives the developing rollers 16*a*, 17*a*, 18*a*, the toner supply augers 216*a*, 217*a*, 218*a*, developer driving clutch 168 and the black developing device 14, and the first to third stepping motors 121 to 123 and so on.

The output timing of the first to third stepping motors 121 to 123 is controlled in accordance with the quantity of remaining toner in the toner cartridges 216, 217 and 218 of the revolver unit 20. For example, it is assumed that the quantity of remaining toner in the yellow (Y) toner cartridge 216 is larger than that of the others, that is, the magenta (M) and cyan (C) toner cartridges 217 and 218. In this case, the stepping motor close to the yellow (Y) developing cartridge 16 has a greater load torque with the follower gear 20*b*, than the stepping motor farther from the yellow (Y) developing cartridge 16. Thus, when rotationally moving the revolver unit 20, the stepping motors situated left and right to the yellow (Y) developing roller 16*a* are driven first. After that, driving of the remaining stepping motor is started.

The CPU 150 drives the stepping motors 121 to 123 and the developer motor 167 in accordance with the result of detection by the toner density sensor 120, and carries out toner supply from the toner cartridges 216, 217 and 218 to the developing device units 116, 117 and 118. Also, in order to detect change in the centroid position of the revolver unit 20, the CPU 150 recognizes the quantity of remaining toner of the toner cartridges 216, 217 and 218 (the weight of the developing cartridges 16, 17 and 18) in accordance with data of the number of times of supply counters 216*b*, 217*b* and 218*b*. The CPU 150 detects change in the centroid position of the revolver unit 20 on the basis of the quantity of remaining toner in the toner cartridges 216, 217 and 218. Therefore, the CPU 150 controls the motor driver 162 to adjust the driving timing of the stepping motors 121 to 123 in accordance with the quantity of remaining toner in the toner cartridges 216, 217 and 218. Also, the CPU 150 has a memory 150*a* which stores count data from the number of times of supply counters 216*b*, 217*b* and 218*b*.

Next, an image forming process in the color printer 1 will be described. In this first embodiment, toner images are formed in order of black, cyan (C), magenta (M), and yellow (Y) in the printer unit 2. At the time of warm-up, first, the home position of the revolver unit 20 is detected by the home position sensor 125. When the image forming process is started, the stepping motors 121 to 123 are driven to rotationally move the revolver unit 20 in the direction of the arrow m to a retreat position with reference to the detected home position. The retreat position means a position to which the yellow (Y), magenta (M) and cyan (C) developing rollers 16*a*, 17*a* and 18*a* are retreated from the developing position facing the photoconductive drum 10. The output timing of the stepping motors 121 to 123 in this case will be described later.

In the state where the revolver unit 20 has retreated in this manner, the photoconductive drum 10 is rotated in the direction of the arrow s and the photoconductive drum 10 is uniformly charged by the charger device 12 in accordance with its rotation. Next, the photoconductive drum 10 is irradiated with a laser beam corresponding to a black image signal by the laser exposure device 13 and an electrostatic image is formed thereon. Moreover, the photoconductive drum 10 is developed by the black developing device 14. After that, the toner image on the photoconductive drum 10 is transferred in primary transfer to an image forming position on the transfer belt 21 by the primary transfer roller 37. After the end of primary transfer, the photoconductive drum 10 has its surface cleaned by the drum cleaner 22 and has its surface charges removed by the electricity removing LED 23.

After the black image forming operation ends, the retreated revolver unit 20 is turned in the direction of the arrow m by the stepping motors 121 to 123, and the cyan (C) developing cartridge 18 is moved to the developing position. Thus, the cyan (C) developing roller 18*a* is moved to the developing position facing the photoconductive drum 10. The developing operation with the cyan (C) developing cartridge 18 is similar to the developing operation by the black developing device 14, except that the development is carried out by the revolver unit 20. While the cyan (C) developing cartridge 18 is thus situated at the developing position, the toner density sensor 120 detects toner density near the developing roller 17*a* of the magenta (M) developing cartridge 17.

After that, the cyan (C) toner image formed on the photoconductive drum 10 is transferred to the image forming position on the transfer belt 21, where the black toner image has been formed. After transfer, the photoconductive drum 10 is cleaned by the drum cleaner 22 and has its surface charges removed by the electricity removing LED 23.

Similarly, magenta (M) and yellow (Y) toner images are transferred to the image forming position on the transfer belt 21, and a full-color toner image is thus formed on the transfer belt 21. After that, the toner image formed on the transfer belt 21 is transferred in one shot to the sheet paper P carried from the paper feed unit 3 synchronously with the toner image, at the position of the secondary transfer roller 28. After that, the sheet paper P with the toner image has the toner image fixed thereon by the fixing device 30 and is then discharged to the paper discharge unit 24. The image forming process is thus completed.

Figure 6:
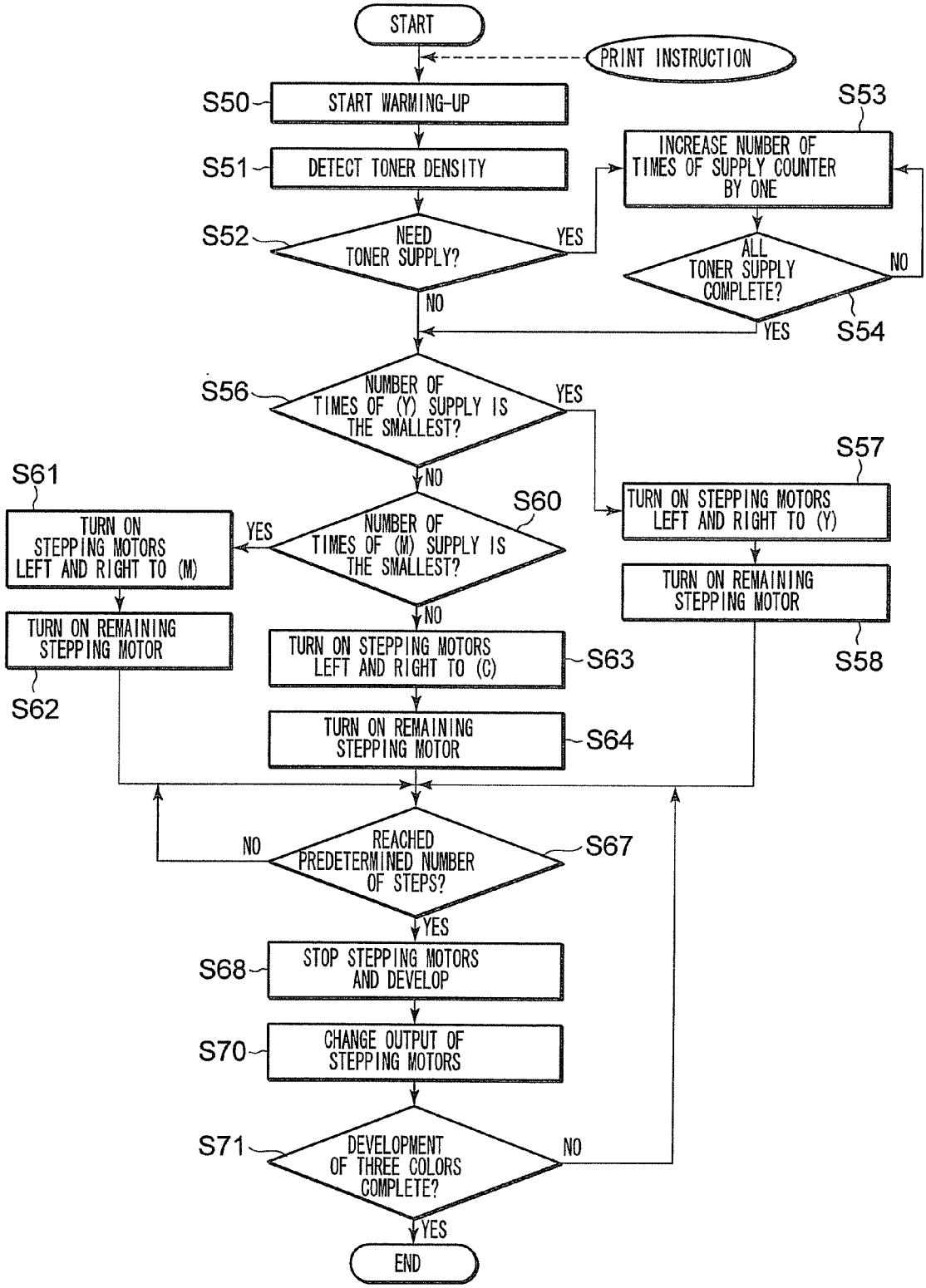
FIG. 6 is a flowchart showing the operation of the stepping motor to drive the revolver unit according to the first embodiment of the invention.

Next, the output timing of the first to third stepping motors 121 to 123 in the case of rotationally moving the revolver unit 20 to the retreat position or in the case of moving the yellow (Y), magenta (M) and cyan (C) developing cartridges 16, 17 and 18 to the developing position will be described in detail with reference to the flowchart shown in FIG. 6. At the start, the color printer 1 starts warming up (step 50). While warm-up is being carried out, the revolver unit 20 is rotationally driven and the operation to detect the home position is carried out by the home position sensor 125.

At the time of the home position detecting operation, the first to third stepping motors 121 to 123 are driven. As all the first to third stepping motors 121 to 123 are rotated, it is determined which position (for example, the home position or the developing position) each of the developing cartridges 16, 17 and 18 is situated at. In accordance with the result of this determination, the subsequent operation to rotate the revolver unit 20 is carried out.

At the time of home position detection during warm-up, the toner density sensor 120 detects toner density near the developing rollers 16*a*, 17*a* and 18*a* of the yellow (Y) magenta (M) and cyan (C) developing cartridges 16, 17 and 18 (step 51). When a print instruction is inputted during this operation, it is determined whether toner supply is necessary, in accordance with the result of detection by the toner density sensor 120 (step 52). The rotation of the revolver unit 20 is stopped while the toner density is detected.

If it is determined in step 52 that toner supply is necessary, the developing cartridge of the color required for toner supply is moved to the developing position. At this time, in the revolver unit 20, first, the stepping motors situated left and right to the developing roller of the developing cartridge having a large quantity of remaining toner are driven with reference to the count data of the number of times of supply counters 216*b*, 217*b* and 218*b* stored in the memory 150*a* of the CPU 150, and then the remaining stepping motor is driven.

In this manner, as the driving timing of the stepping motor having a heavy weight and situated at a position with a large load torque with the follower gear 20*b* is made earlier, the movement of the entire revolver unit 20 becomes smoother when it's driving starts. Therefore, it is possible to restrain vibration of the revolver unit 20 and hence to restrain noise.

When the developing cartridge which needs toner supply has reached the developing position, the developer motor 167 is driven to rotate the toner supply auger of the toner cartridge situated at the developing position, thus supplying toner. The number of times of supply counter is increased by 1 for the color used for the toner supply (step 53). Toner supply is repeated until the toner density of the developing device unit reaches prescribed density (step 54). The rotation of the revolver unit 20 is stopped during toner supply.

When the toner density of the developing device unit has reached the prescribed density in step 54, the stepping motors 121 to 123 are driven to turn the revolver unit 20 in the direction of the arrow m and the cyan (C) developing cartridge 18 is moved to the developing position in order to carry out developing operation. At the time of turning the revolver unit 20, the CPU 150 controls the output timing of the stepping motors 121 to 123 in accordance with the quantity of remaining toner in the toner cartridges 216, 217 and 218.

That is, first, it is identified whether the number of times of supply from the yellow (Y) toner supply auger 216*a* is the smallest, compared with the number of times of supplying the other colors (step 56). If it is the smallest, the CPU 150 determines that the quantity of remaining toner in the yellow (Y) toner cartridge 216 is the largest and that it is the heaviest. Then, the two stepping motors situated left and right to the yellow (Y) developing roller 16*a* are turned on first (step 57). After that, the remaining one stepping motor is turned on in delayed timing (step 58) and the processing shifts to step 67.

If the number of times of supply from the yellow (Y) toner supply auger 216*a* is not the smallest in step 56, the processing goes to step 60 and it is identified whether the number of times of supply from the magenta (M) toner supply auger 217*a* is the smallest, compared with the number of times of supplying the other colors. If it is the smallest, the CPU 150 determines that the quantity of remaining toner in the magenta (M) toner cartridge 217 is the largest and that it is the heaviest. Then, the two stepping motors situated left and right to the magenta (M) developing roller 17*a* are turned on first (step 61). After that, the remaining one stepping motor is turned on in delayed timing (step 62) and the processing shifts to step 67.

If the number of times of supply from the magenta (M) toner supply auger 217*a* is not the smallest in step 60, the CPU 150 determines that the quantity of remaining toner in the cyan (C) toner cartridge 218 is the largest and that it is the heaviest. The processing then goes to step 63. In step 63, the two stepping motors situated left and right to the cyan (C) developing roller 18*a* are turned on first. After that, the remaining one stepping motor is turned on in delayed timing (step 64) and the processing shifts to step 67. In the case where any of the developing cartridges 16, 17 and 18 is replaced by a new one, the count value of the number of times of supply counter for the replaced developing cartridge is reset to zero.

When the operation steps of the stepping motors 121 to 123 have reached a predetermined number of steps in step 67, the stepping motors 121 to 123 are stopped (step 68). At this time, the cyan (C) developing cartridge 18 moves to the developing position and the electrostatic latent image on the photoconductive drum 10 is developed by the cyan (C) developing cartridge 18.

After the development ends, the revolver unit 20 is rotated in the direction of the arrow m in order to move the magenta (M) developing cartridge 17 to the developing position. In this case, since the positions of the yellow (Y), magenta (M) and cyan (C) developing cartridges 16, 17 and 18 have shifted, the stepping motors required to have earlier output timing are changed accordingly (step 70). That is, irrespective of the shift of the developing cartridges, the two stepping motors situated left and right to the toner supply auger of the heaviest toner cartridge are always turned on first.

After that, similarly to the development by the cyan (C) developing cartridge 18, the stepping motors are operated a predetermined number of steps and then the stepping motors 121 to 123 are stopped. In this case, the magenta (M) developing cartridge 17 is situated at the developing position and the electrostatic latent image on the photoconductive drum 10 is developed by the magenta (M) developing cartridge 17.

After the development ends, similarly to the above, the yellow (Y) developing cartridge 16 is moved to the developing position, and the electrostatic latent image on the photoconductive drum 10 is developed by the yellow (Y) developing cartridge 16. Also at the time of rotating the revolver unit 20 for this purpose, the stepping motors required to have earlier output timing are changed in accordance with the shift of the positions of the yellow (Y), magenta (M) and cyan (C) developing cartridges 16, 17 and 18.

Thus, in the revolver unit 20 according to the first embodiment, whichever position the yellow (Y), magenta (M) and cyan (C) developing cartridges 16, 17 and 18 are situated at when rotating the revolver unit 20, the two stepping motors situated left and right to the toner supply auger of the heaviest toner cartridge are always turned on first. After that, the remaining stepping motor is turned on in delayed timing.

After that, in step 71, comparison is made to determine whether the developing operation with all the three colors of cyan (C), magenta (M) and yellow (Y) has been completed. If the developing operation with all the three colors has not been completed, the processing returns to step 67. If it is determined in step 71 that the developing operation with all the three colors has completed, the operation to drive the revolver unit 20 ends.

According to the first embodiment, the driving shafts 121*a*, 122*a* and 123*a* of the first to third stepping motors 121 to 123 engage with the follower gear 20*b* of the revolver unit 20, and the revolver unit 20 is rotationally driven by the three stepping motors 121 to 123. Therefore, despite the heavy weight of the revolver unit 20, the load torque in the parts where the follower gear 20*b* engages with the driving shafts 121*a*, 122*a* and 123*a* can be significantly reduced, compared with the case of driving it by a single stepping motor.

Thus, even when the driving torque of the stepping motors is decreased, the stepping motors do not step out or vibrate, and satisfactory operation of the stepping motors enables stable driving of the revolver unit 20. That is, reduction in size and price of the stepping motors can be realized and energy saving can be achieved. Also, since the load torque in the parts where the follower gear 20*b* engages with the driving shafts

121*a*, 122*a* and 123*a* can be reduced, durability of the follower gear 20*b* can be improved. Moreover, when stopping the rotation of the revolver unit 20, since the load torque in the parts where the follower gear 20*b* engages with the driving shafts 121*a*, 122*a* and 123*a* is small, stable control operation can be realized and deviation from the stopping position can be prevented more securely. As a result, it is possible to stably drive the revolver unit 20 using less expensive stepping motors and to easily deal with demands for higher-speed operation of the color printer 1.

Moreover, in the first embodiment, the weight of each of the toner cartridges 216, 217 and 218 is identified on the basis of the quantity of remaining toner in the toner cartridges 216, 217 and 218 of the developing cartridges 16, 17 and 18. The output timing of the stepping motor closer to the developing cartridge 16, 17 or 18 having a large quantity of remaining toner and a heavy weight is made earlier, and the output timing of the stepping motor that is situated far from this developing cartridge is delayed. Thus, despite the imbalance of weight of the revolver unit 20, the revolver unit 20 can be rotationally driven in a well-balanced manner and hence efficiently. Further reduction in vibrations enables prevention of noise and achievement of further energy saving.

In the first embodiment, the output timing of the first to third stepping motors 121 to 123 is adjusted in accordance with the weight balance of the revolver unit 20. However, the invention is not limited to this. For example, the magnitude of driving torque of the three stepping motors may be adjusted in accordance with the weight balance of the revolver unit. That is, driving torque of the stepping motor close to the developing cartridge having a large quantity of remaining toner and having a heavy weight may be increased, and driving torque of the stepping motor situated far from this developing cartridge may be decreased. By doing so, it is possible to rotationally drive the revolver unit in a well-balanced manner even when the revolver unit has weight imbalance.

Moreover, the three stepping motors may operate constantly with the same output, without adjusting the output in accordance with the weight balance of the revolver unit. By doing so, it is possible to operate the three stepping motors with driving torque of the same magnitude and in the same timing. Thus, the control of the stepping motor can be simplified.

Next, a second embodiment of the invention will be described. The second embodiment has stepping motors that are different from those of the above first embodiment. The other parts are similar to those of the first embodiment. Therefore, in the second embodiment, the same configuration as described in the above first embodiment are denoted by the same reference numerals and will not be described further in detail.

Figure 7:
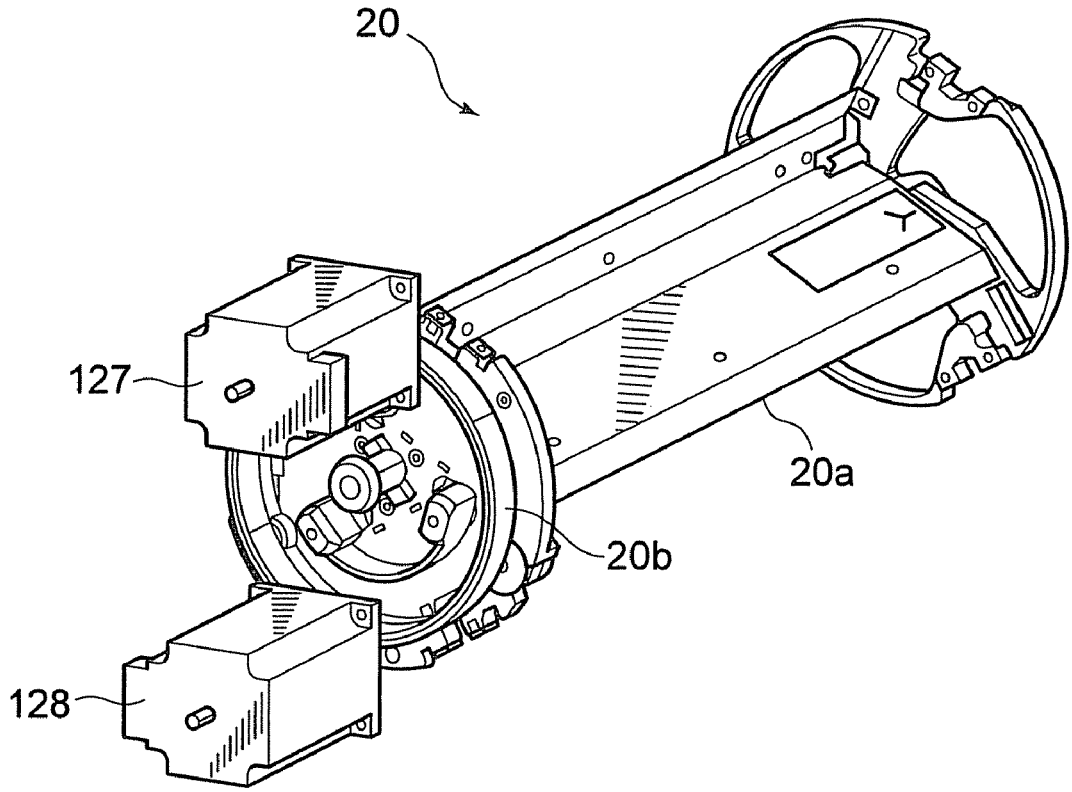
FIG. 7 is a schematic perspective view showing a holding member of a revolver unit and a stepping motor according to a second embodiment of the invention.
Figure 8:
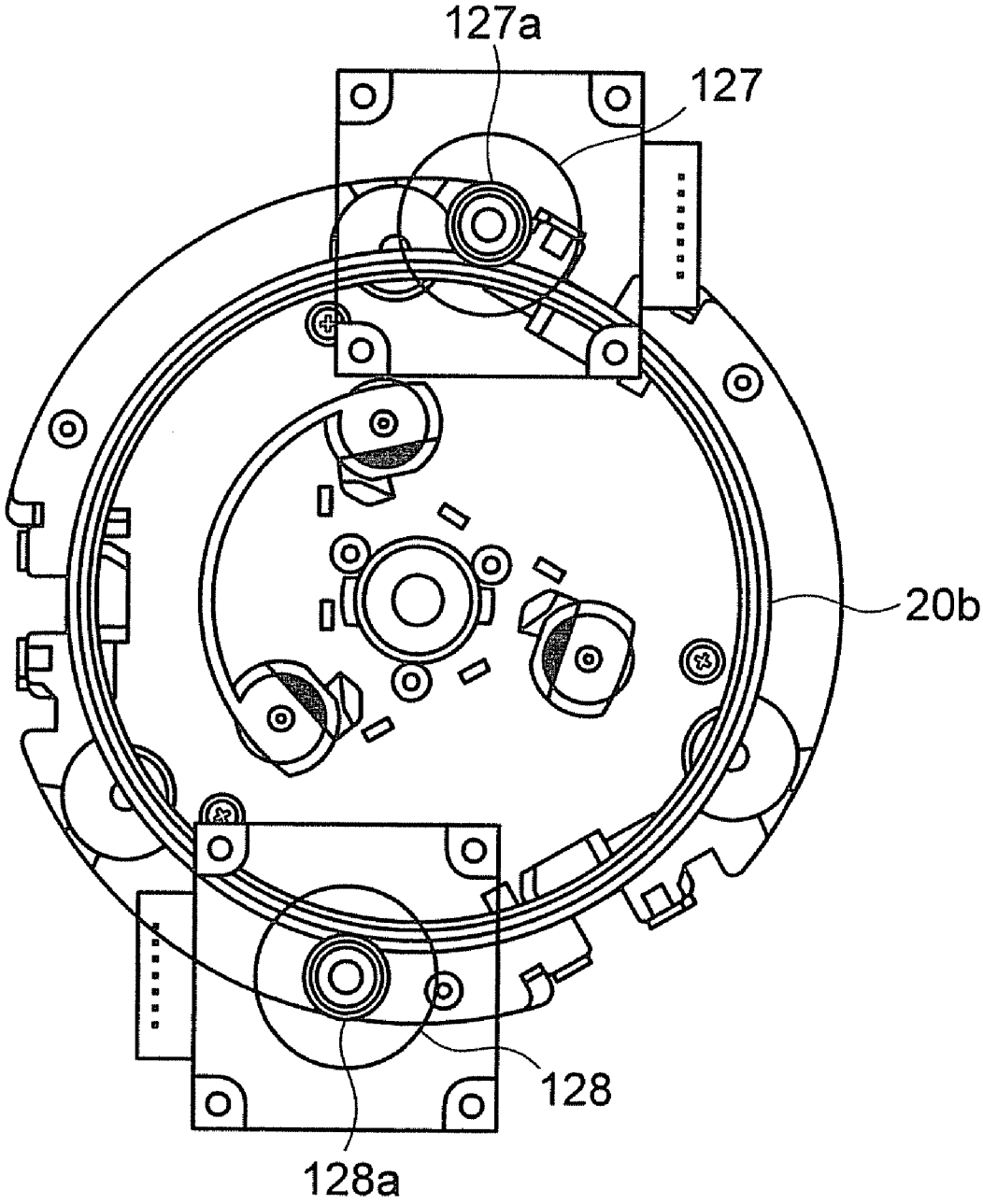
FIG. 8 is a schematic explanatory view showing a follower gear of the holding member and the stepping motor according to the second embodiment.

In the second embodiment, as shown in FIG. 7 and FIG. 8, a main stepping motor 127 and an auxiliary stepping motor 128 having a smaller maximum driving torque than the main stepping motor 127 are provided in the rear side of the color printer 1. Driving shafts 127*a* and 128*a* of the main and auxiliary stepping motors 127 and 128 engage with the follower gear 20*b* on the rear side of the holding member 20*a*. In the second embodiment, the revolver unit 20 is rotationally driven by the two stepping motors 127 and 128 having different maximum driving torques.

In the second embodiment, at the time of any of detection of the home position of the revolver unit 20, toner supply, and development, the main and auxiliary stepping motors 127 and 128 are simultaneously operated to rotationally drive the revolver unit 20.

According to the second embodiment, since the revolver unit 20 is rotationally driven by the main and auxiliary stepping motors 127 and 128, the load torque in the parts where the follower gear 20*b* engages with the driving shafts 127*a* and 128*a* can be reduced, compared with the conventional case of driving it by a single stepping motor. Thus, as in the above first embodiment, reduction in size and price of each stepping motor can be realized and consumption energy can be saved. Moreover, durability of the follower gear 20*b* can be improved. As a result, it is possible to easily deal with demands for higher-speed operation of the color printer 1.

In the second embodiment, the main stepping motor and the auxiliary stepping motor are used as two stepping motors. However, the invention is not limited to this. For example, the two stepping motors which rotationally drive the revolver unit may have the same maximum driving torque. Moreover, the output timing of the stepping motor closer to the developing cartridge which has a large quantity of remaining toner and having a heavy weight may be made earlier, and the output timing of the other stepping motor may be delayed. Alternatively, the stepping motors may be controlled to increase the driving torque of the stepping motor closer to the developing cartridge having a heavy weight and to decrease the driving torque of the other stepping motor.

This invention is not limited to the above embodiments. Various modifications can be made within the scope of the invention. For example, the color of toner in the developers held in the developing unit is not limited. As for the number of developers to be held therein, a developer having black toner may be added, and four developers may be held. Also, the method for measuring the quantity of remaining toner in the developers provided in the developing unit is not limited. For example, it may be measured on the basis of permeability of the toner in the toner cartridges. Moreover, the number of the driving members which rotationally drive the developing unit, their maximum driving torque, and the positions where they are arranged, are not limited.

As described above in detail, according to the invention, as the developing unit having a plurality of developers and having a heavy weight is rotationally driven by a plurality of driving members, the driving torque of the individual driving members can be reduced, compared with the conventional technique. Therefore, the developing unit can be rotationally driven stably and securely by the small-size and inexpensive driving members. Also, there is no risk that the developing unit deviates from the stopping position at the time of development. A developed image of good quality can be provided and consumption energy can be saved. Moreover, the gear provided on the developing unit side can have a longer life.

What is claimed is:

1. An image forming apparatus comprising: a developing unit which has a plurality of developers to move to a developing position and develop an electrostatic latent image and which is rotatably supported in an image forming apparatus body; and a plurality of driving motors which rotationally drive the developing unit and move a desired one of the developers to the developing position.

2. The image forming apparatus according to claim 1, wherein the plurality of driving motors have their output controlled in accordance with change in centroid position of the developing unit.

3. The image forming apparatus according to claim 2, wherein the driving motors closer to the centroid position of the developing unit is caused to output in earlier timing than the other driving motors.

4. The image forming apparatus according to claim 2, wherein the driving motors close to the centroid position of the developing unit is driven with a larger driving torque than the other driving motors.

5. The image forming apparatus according to claim 2, wherein the change in the centroid position of the developing unit is detected from a quantity of consumed toner of each of the plurality of developments.

6. The image forming apparatus according to claim 1, wherein the driving motors include a main driving motor and an auxiliary driving motor having a smaller maximum driving torque than the main driving motor.

7. The image forming apparatus according to claim 1, wherein the driving motors are two, and the two driving motors are provided with a shift of 180.degree. from each other in a rotating direction of the developing unit.

8. The image forming apparatus according to claim 7, wherein output timing of the driving motor closer to centroid position of the developing unit is made earlier than output timing of the driving motor far from the centroid position of the developing unit.

9. The image forming apparatus according to claim 7, wherein magnitude of a driving torque of the driving closer to centroid position of the developing unit is made larger than magnitude of a driving torque of the driving motor far from the centroid position of the developing unit.

10. The image forming apparatus according to claim 1, the driving motors are three, and the three driving motors are provided with a shift of 120° from each other in a rotating direction of the developing unit.

11. The image forming apparatus according to claim 10, wherein output timing of the driving motors situated left and right to a developing roller of the developer having a smallest quantity of consumed toner is made earlier than output timing of the other driving motors.

12. The image forming apparatus according to claim 10, wherein a driving torque of the driving motors provided left and right to a developing roller of the developer having a smallest quantity of consumed toner is made larger than a driving torque of the other driving motors.

13. The image forming apparatus according to claim 1, wherein the driving motors include stepping motors.

14. A control method for an image forming apparatus comprising: rotationally driving a developing unit having a plurality of developers and rotatably supported in an image forming apparatus body, by a plurality of driving motors; moving a desired one of the developers to a developing position; and developing by the desired developer.

15. The control method for the image forming apparatus according to claim 14, wherein an output of the plurality of driving motors is controlled in accordance with change in centroid position of the developing unit.

16. The control method for the image forming apparatus according to claim 15, wherein output timing of the driving motor closer to the centroid position of the developing unit is made earlier than output timing of the other driving motors.

17. The control method for the image forming apparatus according to claim 15, wherein a driving torque of the driving motor close to the centroid position of the developing unit is made larger than a driving torque than the other driving motors.

18. The control method for the image forming apparatus according to claim 15, wherein the change in the centroid position of the developing unit is detected from a quantity of consumed toner of each of the plurality of developers.

19. The control method for the image forming apparatus according to claim 14, wherein the plurality of driving motors include a main driving motor and an auxiliary driving motor having a smaller maximum driving torque than the main driving motor.

20. The control method for the image forming apparatus according to claim 14, wherein output timing of the driving motors situated left and right to a developing roller of the developer having a smallest quantity of consumed toner is made earlier than output timing of the other driving motors.

21. The control method for the image forming apparatus according to claim 14, wherein a driving torque of the driving motors provided left and right to a developing roller of the developer having a smallest quantity of consumed toner is made larger than a driving torque of the other driving motors.

22. The control method for the image forming apparatus according to claim 14, wherein the plurality of driving motors include stepping motors.

* * * * *